United States Patent [19]

Maurice et al.

[11] Patent Number: 4,486,960

[45] Date of Patent: Dec. 11, 1984

[54] MODULAR DRIER FOR DRYING GRAINS

[75] Inventors: Jean Maurice, Saint Germain de la Grange; Bernard Vauthier, Paris, both of France

[73] Assignee: Renault Techniques Nouvelles Appliquees, Boulogne-Billancourt, France

[21] Appl. No.: 434,323

[22] Filed: Oct. 14, 1982

[30] Foreign Application Priority Data

Oct. 20, 1981 [FR] France ..... 81 19658

[51] Int. Cl.[3] ..... F26B 17/12

[52] U.S. Cl. ..... 34/64; 34/65; 34/167; 34/169; 34/174

[58] Field of Search ..... 34/47, 56, 86, 64, 65, 34/167, 168, 169, 174

[56] References Cited

U.S. PATENT DOCUMENTS

| | | | |
|---|---|---|---|
| 1,424,565 | 8/1922 | Goskar | 34/65 |
| 2,474,199 | 6/1949 | Lechthaler et al. | 34/174 |
| 3,404,467 | 10/1968 | Burghard | 34/56 |
| 3,629,954 | 12/1971 | Lavalier . | |
| 3,896,562 | 7/1975 | Zimmerman . | |
| 4,106,212 | 8/1978 | Batterton et al. . | |
| 4,263,722 | 4/1981 | Botkins et al. . | |

FOREIGN PATENT DOCUMENTS

| | | |
|---|---|---|
| 2633165 | 1/1978 | Fed. Rep. of Germany . |
| 2262786 | 9/1975 | France . |
| 2272354 | 12/1975 | France . |
| 2427566 | 12/1979 | France . |
| 2444907 | 7/1980 | France . |

*Primary Examiner*—Larry I. Schwartz
*Assistant Examiner*—David W. Westphal
*Attorney, Agent, or Firm*—Oblon, Fisher, Spivak, McClelland & Maier

[57] ABSTRACT

The object of the present invention is a modular drier.

Each module comprises two fans each supplying a common diffusion chamber (14) disposed between two columns of a group of columns (12, 13). Said chambers (14) adjoin a perforated wall of said columns comprising vertical deflectors, with the opposite wall of these columns, likewise perforated, communicating with a common chamber (15) for exhausting the air used for drying.

The invention relates to a modular drier for drying grains, in which gravity draws the grain down in parallel sheets within vertical columns crossed horizontally by the drying air.

6 Claims, 5 Drawing Figures

MODULAR DRIER FOR DRYING GRAINS

The invention at hand relates to a modular drier for drying grain using the so-called column drying technique and consisting of a vertical flow of grain pulled down by gravity in tow sheets crossed successively by the drying air, which circulates in a horizontal path. To compensate for the fact that the air crossing the second sheet is already partially humidified and cooled from passing through the first sheet, causing slower drying, said second sheet circulates more slowly than the first.

In a known device using this drying technique, two drying columns are juxtaposed so as to form a group and the drier comprises two groups placed side-by-side.

In this same known device, the drier consists of indentical superimposed elements or modules, with each module comprising its own ventilation means, as well as individual means for controlling the temperature of the hot air. This modular design has the twin advantage of making possible, using common elements, the construction of a range of driers of very different power by varying the number of modules, as well as enabling individual adjustment of the output and temperature of the air from each module, in order to obtain the most efficient drying with the lowest heat comsumption at the various levels of the column while observing the heat limit of the grain, above which the quality of the grain may deteriorate.

In the known drying device, a single air heater is used to produce hot air for the entire drier at a temperature higher than that needed for the drying air, with this hot air being subsequently diluted with cold air in dilution tanks adjoining each of the modules. In this way the number of heat sources is reduced, lowering the cost of the apparatus.

At the base of the drying columns, the known apparatus comprises a cooling zone consisting of one or more modules analogous to the drying modules but crossed instead by unheated outside air, with the grain cooling in this zone while its temperature becomes uniform and it dries out, without consumption of additional heat.

In the prior art device, the used air leaving all of the modules, includng the cooling modules, is collected from all of the columns through a common exhaust chamber consisting of a tank surrounding these columns and equipped with ducting which sends the used air out into the atmosphere.

Such a device fulfills its functions well but nevertheless has a number of disadvantages. High condensation is produced within the sheets of grain being dried due to the very active evaporation which takes place in the front portion of the sheet of grain and to the temperature differences between the various levels of this sheet. Such condensation traps dust carried by the drying air and causes the grain to stick together in the shape of plugs which block the air and cause localized overheating, with a risk of fire.

Another fire risk in the known device results from the possible presence of combustible dust under the effect of hot air eddies coming into contact with the sheet of grain and from the existence within this hot air flow of a component moving at "sweeping speed, " i.e., parallel to the plane of flow of the grain and often too great.

Lastly, there is substantial heat loss due to the pure and simple exhausting into the atmosphere of still hot air which has passed over the sheets of grain.

The object of the invention at hand is to enable the construction of a drying device of this type which will be free of these drawbacks and which will in particular be more efficient, i.e., which will use less fuel.

Under the invention, a modular drier for drying grains, in which gravity draws the grain down in the form of parallel sheets within vertical columns crossed horizontally by the drying air, with said drier consisting of superimposed modules each comprising pieces of said columns and ventilation means, and with some modules also comprising means for controlling the temperature of the drying air issuing from a common air heater, said columns being arranged in two groups each comprising two columns, and the lower section of said drier comprising a hopper for removing the dried grain from said columns, is characterized in that the width of the columns in the module(s) located at the top of the drier is less than that of the columns in the other modules.

This drier is further characterized in that each module comprises two fans each supplying an air diffusion chamber disposed between the two columns of a group, said chambers adjoining a perforated wall of said columns comprising vertical deflectors, with the opposite wall of these columns, also perforated, communicating with a common exhaust chamber for the air used to dry grain, said chamber being connected with the hopper through an opening provided in the lower portion of said chamber.

The characteristics and advantages of the invention will appear more clearly in the following description, given solely by way of example and with reference to the attached drawings, in which.

Figure 2:
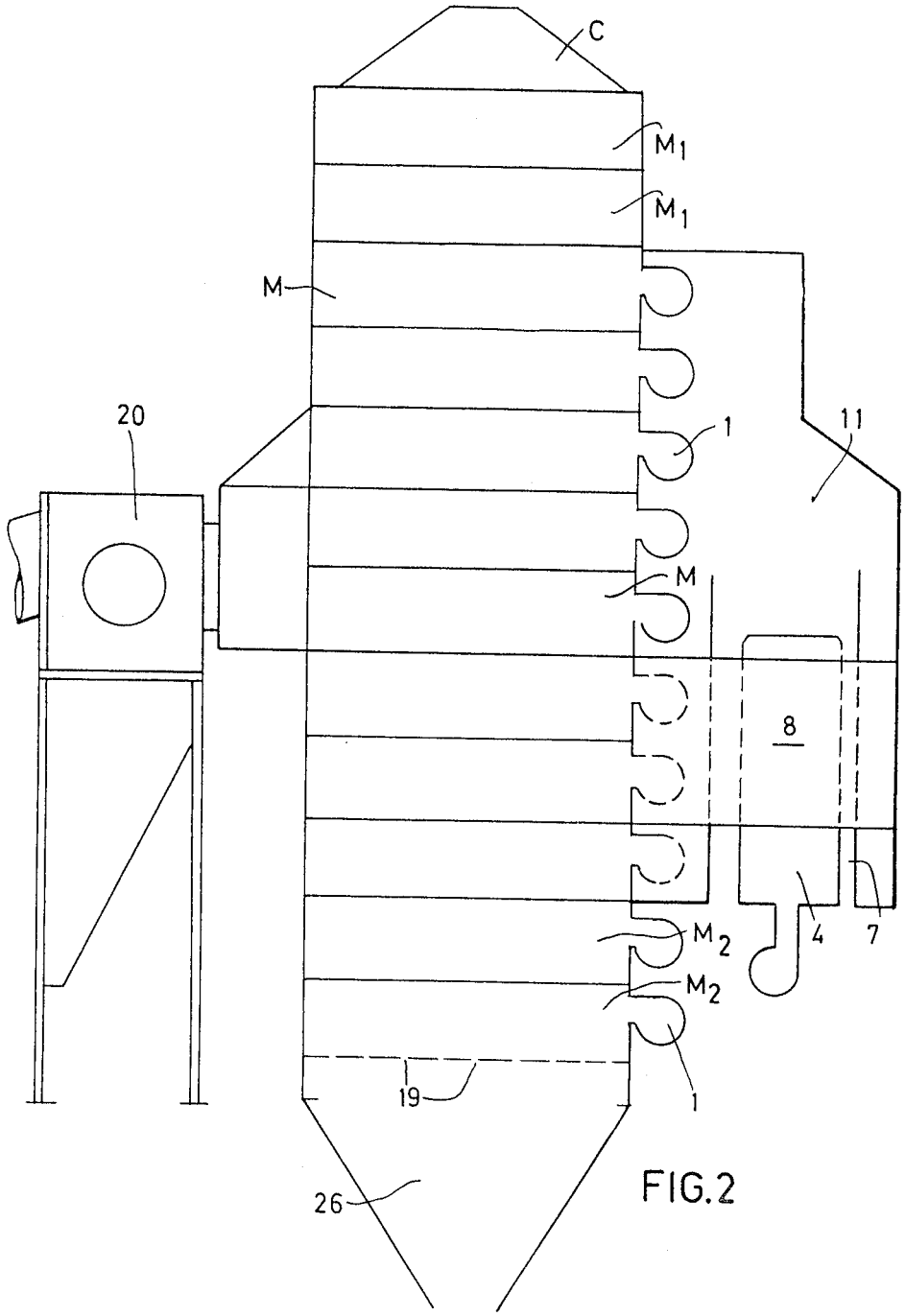

The drier of the invention in the embodiment described and represented consists in a manner in itself known of modules M, generally parallelopiped in shape, stacked one upon the other so as to form a tower (FIG. 2). Each of these modules M comprising pieces of columns 12, 13. With the superimposition of the modules, these pieces form two groups of two columns for the flow of grain to be dried in parallel, vertical sheets.

Figure 1:
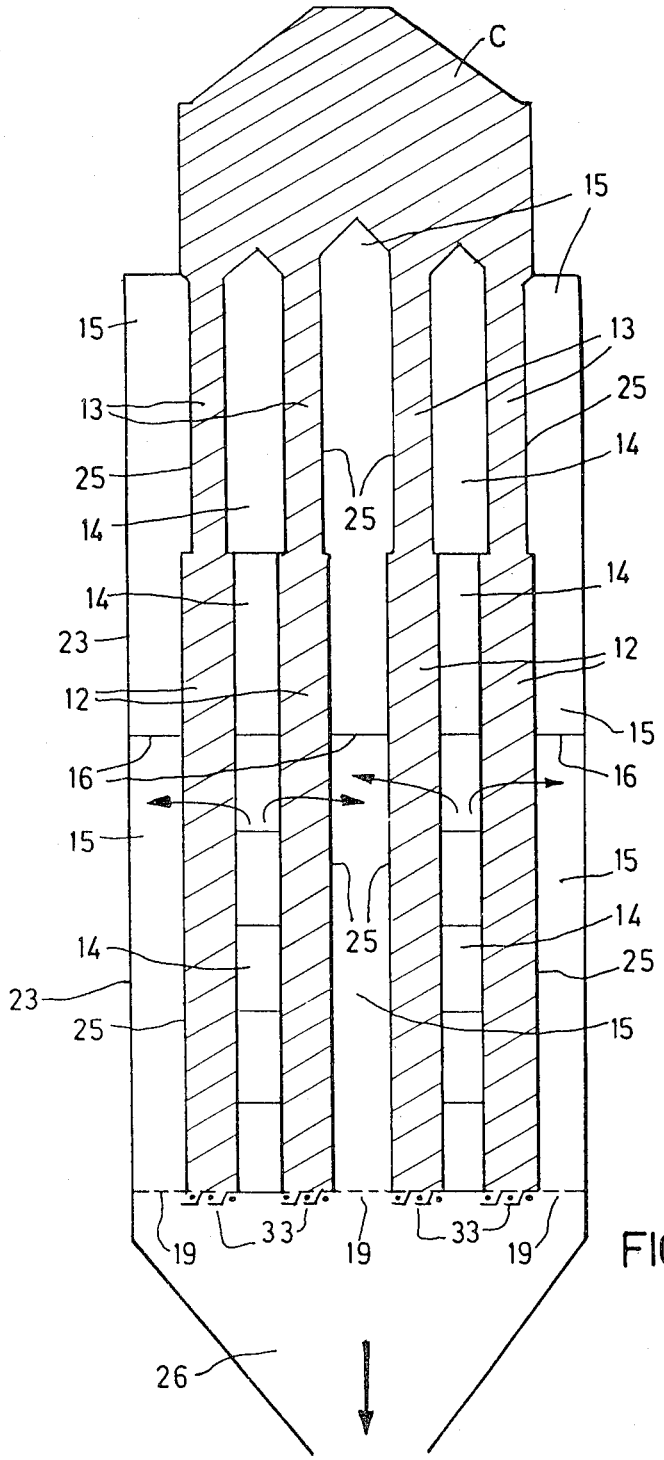
FIGS. 1 through 3 illustrate schematically one embodiment of the drier of the invention, respectively in a longitudinal cross-section along a vertical plane, in elevation, and in transversal cross-section along a horizontal plane.

According to one characteristic of the invention, one or more of drying modules M located in the upper portion of the drier has elements of column 13 which are narrower than element 12 of the lower modules (FIG. 1).

This arrangement tends to avoid the condensation which may occur in the sheets of grain last crossed over by the drying air due to the very active evaporation which is produced at the front of the sheet and to the lesser heating of the grain at the back of the sheet.

As emphasized above, such condensation, because of the plugs and obstructions it entails, may be the cause of localized overheating and fire. These risks are avoided here. The upper part of the drier also comprises one or more grain intake modules M, and a cap C forming the top of the drier, into which is poured the grain to be dried, which in turn is delivered by conventional feed means (not shown) and then flows by gravity into the columns. Each drying module M comprises two fans 1 for drawing drying air into diffusion chambers 14, which are each associated with one of said fans and disposed (each) between the two columns of a group. The drier also comprises a heat generator 4 which is common to all modules M (FIG. 2), with an annular collar 7 channeling cold air heated by contact with a central combustion chamber 8 into a dilution chamber 11 common to the various fans 1. Valves 5, 6 connected to the fans (FIG. 3) make is possible to regulate the dilution of hot by cold drying air within diffusion chambers 14. In certain zones of the column, there is one diffusion chamber per module, while in other zones, a single diffusion chamber may be common to two or more adjacent modules so as to equalize, at least approximately; the temperatures of the respective hot air flow penetrating into the sheet of grain at the level of the various modules.

Figure 5:
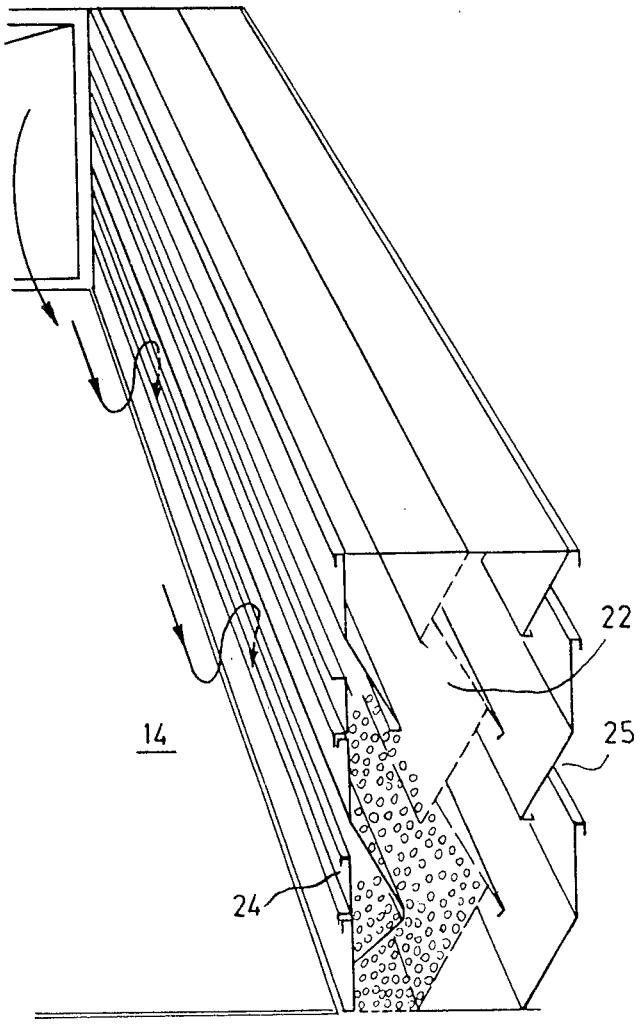
FIG. 5 is a perspective view of a chamber for diffusion of drying air within a sheet of grain, showing, inter alia, air intake regularization deflectors facing the front surface of the sheets of grain.

Within each module M, each piece of column 12, 13 is separated from the associated diffusion chamber by a perforated partition allowing air to pass through and consisting of horizontal sections forming "Venetian blinds" inclined downwards (FIG. 5) so as to distribute the hot air within the sheet of grain. According to one characteristic of the invention, vertical air deflectors 24 form extensions of the edge of these "Venetian blinds," for the purpose of regularizing the intake of air, avoiding eddies and reducing the speed component of the air parallel to the axis of the chamber, called the "longitudinal sweeping component." As indicated above, both eddies and longitudinal sweeping have the effect of bringing in combustible dust and increasing the risk of fire.

After having successively crossed the sheets of grain and through the second, likewise perforated, wall, 25 of the columns, the used air enters an exhaust chamber 15 surrounding said columns and common to the various modules M (FIG. 1).

Said chamber 15 is also common to one more modules $M_2$ analogous to modules M and which, placed under these latter, constitute the lower part of the drier. Though they comprise fans 1 and diffusion chambers 14, these modules $M_2$ are not supplied with hot air, but rather with cold air only, drawn in from outside. They form the cooling zone of the device.

The extreme lower part of the drier comprises a hopper 26 (FIGS. 1 and 2) into which the dried grain flowing from columns 12, 13 is emptied. This hopper also communicates with the used air exhaust chamber 15 through openings 19 provided, for each column, in the lower partition of this chamber.

Thus the light particles expelled from the sheet of grain by the drying air (particularly at the moment the fans are started up) and which tend to be deposited on this lower partition, are carried away by the dry grain with each emptying. This prevents them from accumulating in chamber 15.

Hopper 26 is equipped with discharge dampers 33.

According to one characteristic of the invention, a horizontal partition 16 separates the evacuation chamber into two parts along its height dimension.

Figure 4:
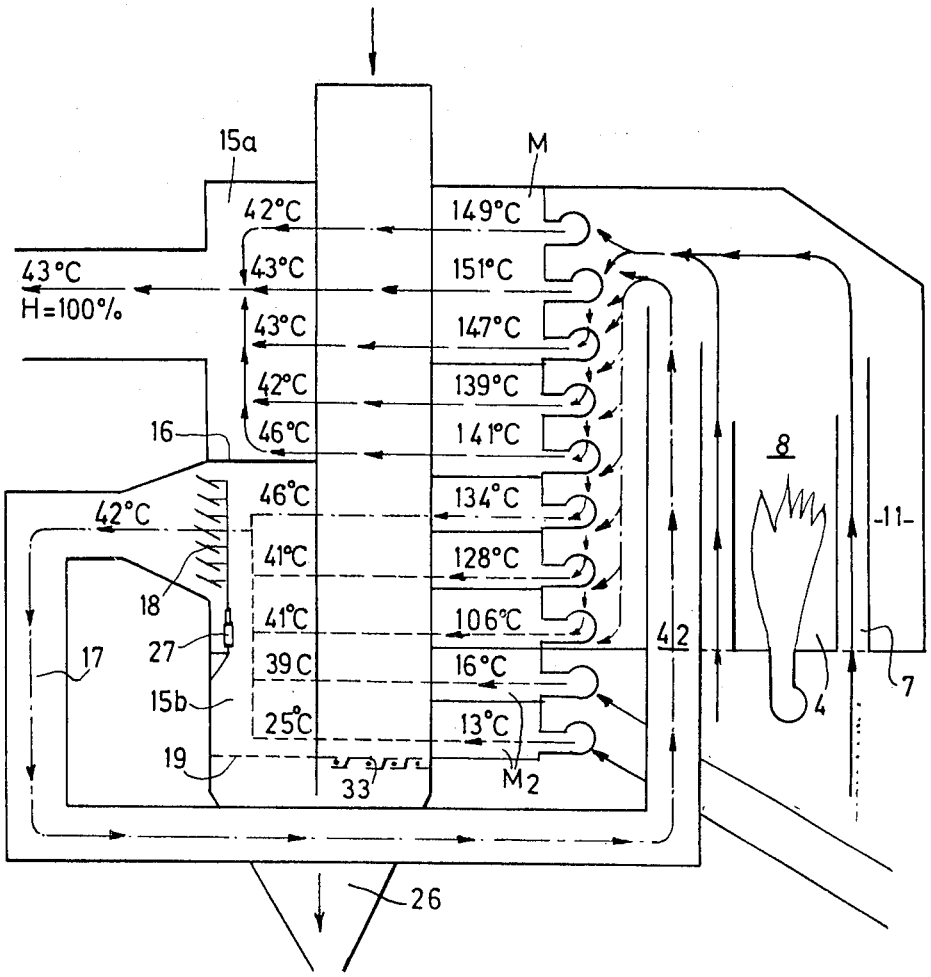
FIG. 4 illustrates schematically a device for recyling part of the used air, with which the drier of the invention may be equipped.

The upper part of said chamber 15, above partition 16 and represented as 15*a* in FIG. 4, is placed in direct contact with the atmosphere, into which the used air from the corresponding modules is exhausted.

Figure 3:
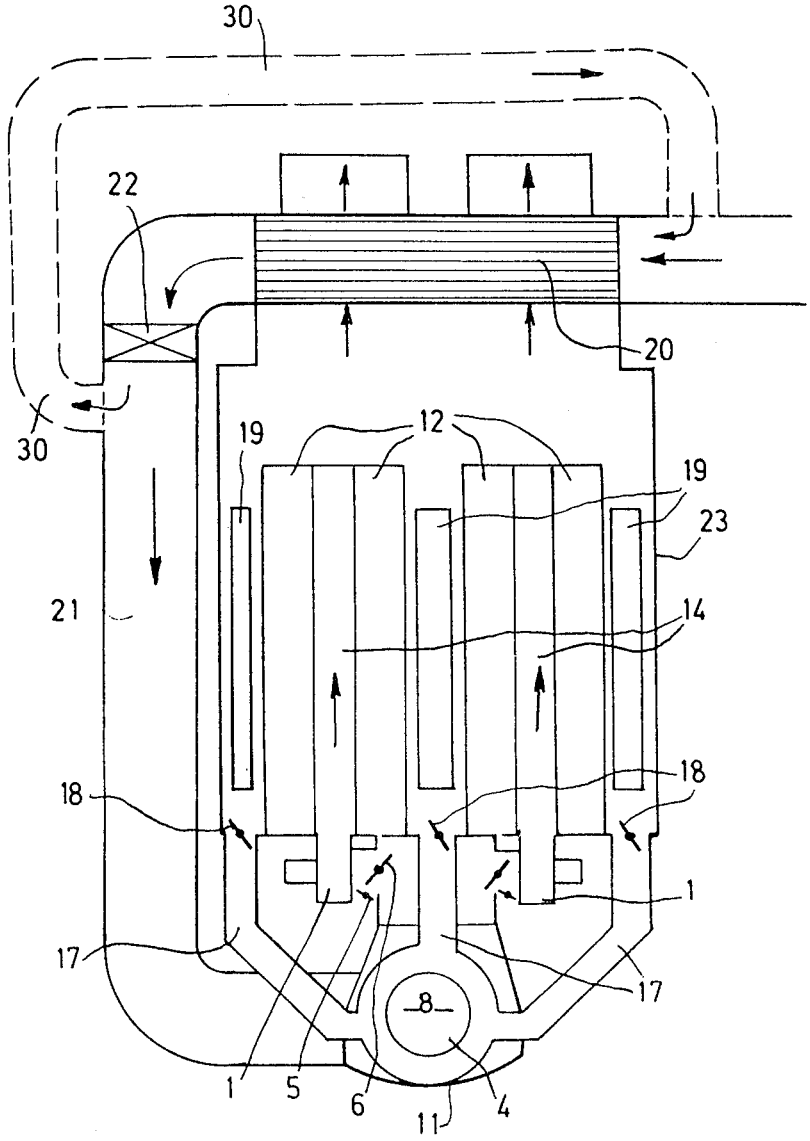

By contrast, lower part 15*b* of chamber 15, corresponding to modules $M_2$ of the cooling zone and to modules M lying immediately above, is connected by means of ducts 17, preferentially heat-insulated, to a zone crossed by the flow of new air before the latter passes through the grain, and preferentially at the outlet of the hot air generator (FIGS. 3 and 4). Thus, used air from the lower part 15*b* of chamber 15 is mixed with new air.

The heat contained in the recycled used air is thus recovered. On the other hand, there results an increase in the humidity of the drying air, an increase capable of reducing the drying capacity of the machine to a certain extent. Because of this, the number of modules for which the recycling of used air is employed will be set by adopting a compromise between the goal of maximum fuel economy and that of the highest possible drying capacity.

Assorted dust and debris tend to be deposited on partition 16, borne by the used air crossing the exhaustion chamber. A scraper (not shown) is advantageously provided to rid the partition of such waste. The scraper consists for example of a chain onto which are welded scraping blades, said chain being manually activated from outside the drier, without it being necessary to curtail the drier's operation. The outlet of the scraper is connected to a bagging spout which allows the waste being removed to be collected.

The invention provides an antidust device to reduce emissions of dust in the lower part of the drier where they are most plentiful because of the dryness of the grain, especially during the intermittent discharges of dry grain controlled (for example) by means of a timer acting upon dampers 33. This device consists of damper 18 (FIG. 4) controlled by a piston 27 and arranged at the entrance of ducts 17 in the lower part of the exhaust chamber.

The timer controlling discharges of grain also acts upon said dampers to block all air circulating in the lower part of the drier, simultaneously stopping the fans. A safety prevents discharge until dampers 18 have closed completely.

The invention further provides for the placement within the drier of a heat exchanger 20, represented in FIGS. 2 and 3, advantageously of the "plates and crossed currents" type represented in 15*a*, FIG. 4. This exchanger 20 exposes very humid and still hot used air, e.g., at a temperature of between 40° and 45° C., to thermal contact with colder incoming air before being exhausted into the atmosphere. This incoming air, preheated for example to a temperature of between 30° and 35° C., is transferred to air heater 4 through duct 21 by the force of a fan 22 (FIG. 3).

This preheating results in a non-negligible saving in fuel and economy.

In the case of heat exchanger 20, it might also be foreseen to add to the "main" air circuit crossing the exchanger and bringing toward the main heater new, cold air taken from the atmosphere and heated in the exchanger, a recycling circuit comprising a channel 30, preferentially heat-insulated, connecting the intake duct of the main circuit to outlet duct 21 of this circuit, bridging both exchanger 20 and fan 22, the output of which is adjusted so as to exceed what is required to supply the drier with new air. Under the effect of the high pressure reigning in the duct, the excess flow created is once again sucked into the exchanger, undergoing a second heating. A partial recycling of the new air across the exchanger is thereby obtained. Because of the fact that the temperature of the exiting used air will be slightly lowered by the prior removal of heat, since the latent heat of condensation that is released from the used air as it cools in the exchangers is very great and limits this cooling to several degrees Celsius, a certain increase in the preheating of new air can be achieved at the price of a slight expense in additional ventilation energy.

It will be noted that the exiting used air is practically saturated with humidity and in passing through exchanger 20 it cools by leaving a partial condensation of this humidity on the plates of the heat exchanger, onto which a portion of the dust contained in the exiting air will tend to stick. To remove water and solid deposits, the exchanger plates are vertically arranged and the used air circulates between these plates from top to bottom. The water contaminated with miscellaneous dust and wastes will thus be flushed downwards, collected in vat, and finally removed through an appropriate pipe. In addition, the exchanger will advantageously contain, within its upper housing, pressurized water sprinkler racks which can be intermittently activated in order to clean the surface of the plates without requiring disassembly.

By way of indication, FIG. 4 gives input and output air temperatures within the various modules, taken in the course of a test of a drier under the invention having a total of 10 modules.

It follows of itself that driers can be constructed under the invention comprising a different number of modules, e.g., between four and six, without these figures being limitative.

The present invention is of course in no way limited to the embodiments described and represented. It is open to numerous variants within reach of the man skilled in the art, following the applications contemplated and without departing from the spirit of the invention.

We claim:

1. A modular grain drier in which gravity draws the grain being dried down in parallel sheets crossed horizontally by drying air, said modular grain drier comprising:

(a) a plurality of superimposed modules which in combination form two groups of grain columns, each group of grain columns comprising two yoked grain columns, the two columns in each group of grain columns being separated by a diffusing chamber through which drying air is blown horizontally and parallel to the adjacent parallel sheets of downwardly descending grain, each of the two groups of grain columns being surrounded by a common used air exhaust chamber which also extends between the two groups of grain columns, the width of the grain columns being greater in the modules at the bottom of the drier than in the modules at the top of the drier, each portion of the grain columns in each module being separated from the associated diffusion chamber and from the common used air exhaust chamber by a perforated partition which allows air to pass through said which comprises a plurality of horizontal sections in the form of downwardly inclined venetian blinds, a vertical air deflector being disposed on the edge of each of said downwardly inclined venetian blinds extending into the associated diffusion chamber to regularize the intake of air, avoid eddies, and reduce the speed component of the drying air in the horizontal direction;

(b) a plurality of ventilation fans, one of said ventilation fans being arranged to pass drying air horizontally through the diffusion chambers in each of said modules;

(c) an air heater which heats the drying air passed through the upper ones of said modules;

(d) a hoppr disposed beneath said modules in position to receive the grain as it issues from the grain columns, said hopper being in fluid communication with the common used air exhaust chamber through openings leading to the common used air exhaust chamber between the two groups of grain columns and outside each group of grain columns;

(e) a horizontal partition which divides the common used air exhaust chamber into an upper part and a lower part, the upper part of the common used air exhaust chamber being in fluid communication with the atmosphere and with a first group of modules which are supplied with drying air heated by said air heater and the lower part of the common used air exhaust chamber being in fluid communication with a second group of modules which are supplied with drying air heated by said air heater and a third group of modules which are supplied solely with unheated air for cooling the grain being dried;

(f) a first air recycling duct which connects the lower part of the common used air exhaust chamber to the supply of drying air heated by said air heater before the heated drying air enters the second group of modules;

(g) means for controlling the proportion of heated drying air and recycled air from said first air recycling duct which enters the second group of modules; and (h) a heat exchanger located in an inlet duct which brings unheated air to said air heater, said heat exchanger bringing unheated air being fed to said air heater into thermal exchange relationship with used air from the upper part of the common used air exhaust chamber.

2. A modular grain drier as recited in claim 1 and further comprising a piston-actuated damper which can close said first air recycling duct.

3. A modular grain drier as recited in claim 2 and further comprising means to stop said ventilation fans when said damper is closed.

4. A modular drier as recited in claim 1 wherein said heat exchanger is of the vertical plates and crossed currents type.

5. A modular drier as recited in claim 4 and further comprising means for sprinkling water on the vertical plates to wash them without requiring the drier to be disassembled.

6. A modular grain drier as recited in claim 1 and further comprising:

(a) a fan located in said inlet duct, said fan serving to pass exterior air through said heat exchanger and into said air heater;

(b) a second air recycling duct which communicates with said inlet duct downstream of said heat exchanger and said fan and upstream of said heat exchanger and said fan; and (c) means for adjusting the output of said fan so that it exceeds what is required to supply the diffusion chambers, whereby a portion of the new air which has passed through said heat exchanger is recycled through said second air recycling duct and reenters said inlet duct upstream of said heat exchanger.

* * * * *